US005534099A

United States Patent [19]

Yamamoto

[11] Patent Number: 5,534,099

[45] Date of Patent: Jul. 9, 1996

[54] PROCESS FOR PRODUCING HEAT-SENSITIVE STENCIL SHEET

[75] Inventor: Yasuo Yamamoto, Tokyo, Japan

[73] Assignee: Riso Kagaku Corporation, Tokyo, Japan

[21] Appl. No.: 283,600

[22] Filed: Aug. 1, 1994

[30] Foreign Application Priority Data

Aug. 2, 1993 [JP] Japan ..... 5-191348

[51] Int. Cl.[6] ..... B41N 1/24; B05D 1/16; B05D 1/04

[52] U.S. Cl. ..... 156/230; 156/309.6; 156/273.1; 427/206; 427/200; 427/462

[58] Field of Search ..... 156/308.2, 309.6, 156/273.1, 324, 230, 279, 238; 427/206, 307, 200, 462

[56] References Cited

U.S. PATENT DOCUMENTS

| | | | |
|---|---|---|---|
| 3,275,487 | 9/1966 | Lemelson | 156/72 |
| 3,798,048 | 3/1974 | Brody et al. | 427/462 |
| 5,262,221 | 11/1993 | Terada et al. | 428/195 |
| 5,270,099 | 12/1993 | Kamiyama et al. | 428/195 |
| 5,458,915 | 10/1995 | Yamamoto | 427/206 X |

FOREIGN PATENT DOCUMENTS

| | | |
|---|---|---|
| 583959 | 2/1994 | European Pat. Off. . |
| 9112194 | 11/1991 | Germany . |
| 62-184888 | 8/1987 | Japan . |
| 63-283778 | 11/1988 | Japan . |
| 2127713 | 4/1984 | United Kingdom . |

*Primary Examiner*—Michael W. Ball
*Assistant Examiner*—Sam Chuan Yao
*Attorney, Agent, or Firm*—Fay, Sharpe, Beall, Fagan, Minnich & McKee

[57] ABSTRACT

A process for producing the heat-sensitive stencil sheet is described which is a simple process, makes it possible to readily form a porous substrate layer having a good fiber dispersibility on a thermoplastic resin film without intervening any adhesive layer and allows to carry out a single production line from beginning to end. The process comprises: a process characterized by dispersing polyester binder fibers on the surface of a thermoplastic resin film by an electrostatic flocking process, thermally compressing so as to form a porous substrate layer on a stencil sheet, electrostatically flocking polyester binder fibers on the surface of a released member, then superimposing a thermoplastic resin film on the fibers-flocked surface on the released member, thermally compressing the superimposed film, and removing the released member to obtain a heat-sensitive stencil sheet; and another process characterized by electrostatically flocking polyester binder fibers on the surface of a thermoplastic resin film and thermally compressing the fibers-flocked film to form a porous substrate layer on the thermoplastic resin film.

1 Claim, 1 Drawing Sheet

PROCESS FOR PRODUCING HEAT-SENSITIVE STENCIL SHEET

BACKGROUND OF THE INVENTION

1. Field of the Invention

The present invention relates to a process for producing a heat-sensitive stencil sheet. Specifically, it relates to a process for producing a heat-sensitive stencil sheet, which has a porous substrate layer having a good fiber dispersibility and no adhesive layer resides in.

2. Description of the Prior Art

In a prior art, a heat-sensitive stencil sheet is produced by adhering a thermoplastic resin film on a porous substrate such as a porous thin sheet with an adhesive. For example, one surface of an original and a resin film of a heat-sensitive stencil sheet are brought into contact with each other and irradiated by light from the side of the porous substrate of the heat-sensitive stencil sheet in order to generate heat at the black image portion of the original, thereby the heat-sensitive stencil sheet being engraved either by melting and perforating the film of the heat-sensitive stencil sheet with the aid of the generated heat or by reading the original image by an image sensor and then by melting and perforating the film of the heat-sensitive stencil sheet corresponding to the original image by means of a thermal head. The pictorial property of the printed matter obtained by using such a heat-sensitive stencil sheet is, however, influenced not only by the perforating property of the heat-sensitive stencil sheet but also by the fiber dispersibility in the substrate.

Since an adhesive layer is, however, presented between the film and the substrate in the prior art heat-sensitive stencil sheet described above, there was the disadvantage in that the perforating property is obstructed. It was also difficult from the standpoint of strength to prepare a porous substrate having a low fiber density and a good fiber dispersibility. Furthermore, since the heat-sensitive stencil sheet of the prior art is produced by once preparing a porous substrate and then by laminating a film on the resulting substrate, the process was complicated and there was the problem that the heat-sensitive stencil sheet could not be prepared by using a single production line from beginning to end.

SUMMARY OF THE INVENTION

It is a main object of the present invention to solve the problems of the prior art described above and to provide a heat-sensitive stencil sheet and its production process which is a simple process by using a single production line from beginning to end, and which makes it possible to readily form a porous substrate layer on a thermoplastic resin film with a uniform and dense fiber dispersion.

The present invention to be claimed in this application will be as follows:

(1) A process for producing a heat-sensitive stencil sheet comprising the steps of:
- flocking polyester binder fibers on the surface of a released member electrostatically;
- superimposing a thermoplastic resin film on the fibers-flocked released member;
- thermally compressing the superimposed film and fibers-flocked released member; and
- removing the released member to obtain a heat-sensitive stencil sheet.

(2) A process for producing a heat-sensitive stencil sheet comprising the steps of:
- flocking polyester binder fibers on the surface of a thermoplastic resin film electrostatically; and
- thermally compressing the electrostatically fibers-flocked thermoplastic resin film to form a porous substrate layer on the thermoplastic resin film.

There is no particular limitation to the thermoplastic resin films to be used in the invention, and as a thermoplastic resin in the invention, polyester (polyethylene, terephthalate), polyvinylidene chloride, polypropylene or vinylidene chloride-vinyl chloride copolymer can be exemplified. In view of the affinity of each thermoplastic resin film with polyester binder fibers, polyester film (polyethylene terephthalate film) is most preferable. The film thickness in each thermoplastic resin film may be usually in the range of 0.5 μm–5 μm.

As a polyester binder fiber to be used in the present invention, all melted type polyester fibers composing of a lower melting point polyester, for example, a copolymerized polyester, shell-core type conjugate polyester fibers or side-by-side type conjugate polyester fibers can be exemplified. The above-mentioned conjugate fiber consists of a lower melting component and a higher melting component, such as a combination of copolymerized polyester and homo polyester such as polyethylene terephthalate. The copolymerized polyester can be obtained by adding other monomer or reaction components such as polyethylene glycol at the time of preparing polyethylene terephthalate. As the other monomer or reaction components, a dicarboxylic acid such as isophthalic acid, adipic acid or dimer acid, a lower molecular weight glycol such as ethylene glycol or butanediol, and polyalkylene glycols such as polyethylene glycol or polytetramethylene glycol are exemplified. The sectional shapes of these fibers may be round or modified. These fibers may be used in admixture. In the shell-core type fibers, there is no particular limitation to the core components so long as any lower melting point polyester components are used as a shell component. In the case of the side-by-side type fibers, any lower melting point polyester components can be used as one of the components. Of all these fibers, the conjugate fibers, particularly shell-core type conjugate fibers are preferable from the stand point of their deformities after they are thermally compressed.

Each fibre length of polyester binder fibers is preferably in the range of 0.1 mm–2.0 mm. In the case that the fiber length is shorter than 0.1 mm, the heat adhesion between the fibers at a time of thermal compression becomes insufficient and it is also hard to cut the fibers so short. When the fiber length exceeds 2.0 mm, the fibers are easily intermingled together. Furthermore, the fineness of polyester binder fibers is preferably set to be in the range of 0.1 denier–4.0 denier. It is difficult to obtain the fibers of less than 0.1 denier. Their perforating property becomes worse when the fineness exceeds 4.0 denier.

Polyester binder fibers are usually subjected to surface treatment prior to electrostatic flocking process. In the present invention, as the surface layer covering the heating elements of a thermal head is formed by a glassy material in the case of engraving by the thermal head, it is preferable from the stand point of protecting the glassy material to treat polyester binder fibers by using a nonionic surfactant containing no alkali metals and chlorine components and to remove the sticky feeling from the surfactants by using colloidal silica containing a small amount of alkali metals.

It is preferable from the viewpoint of fiber density, strength or perforated pictorial property, to set an amount of flocked polyester binder fibers as to be in the range of 5 g/cm$^2$–20 g/m$^2$.

BRIEF DESCRIPTION OF THE DRAWINGS

The invention will now be described with references to the accompanying drawings as follows.

FIG. 1 is an explanatory view showing an example of the electrostatic flocking process in the present invention.

Figure 1:
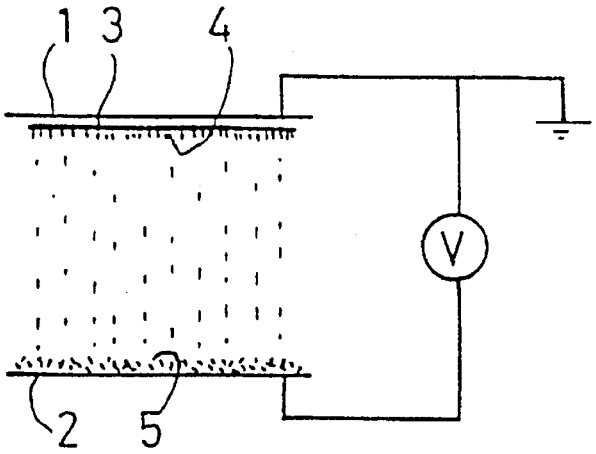
FIG. 1 is an explanatory view showing an example of an electrostatic flocking process according to the present invention.

In the drawing, a pair of electrode plates 1 and 2 are arranged across the space of 5 cm between them while facing each other, polyester binder fibers 5 are mounted on the surface of the electrode plate 2, and a released paper 3 is attached on the electrode plate 1 while facing the electrode plate 2. When a direct current voltage of 6000 V is applied on the electrode plates 1 and 2, the polyester binder fibers 5 are electrified, transferred toward the electrode plate 1, stand upright on the released paper 3 and electrostatically flocked. Applied time is properly chosen depending upon an applied voltage and a flocked quantity, but it is usually about 1 sec–10 sec.

A thermoplastic film is superimposed on flocked fibers 4 flocked on the released paper 3, and then passed through the heat rollers so as to be thermally compressed thereby, followed by cooling down and releasing the releasing paper, to form a heat-sensitive stencil sheet. In the present invention, the thermoplastic film is mounted on the electrode plate 1, and the polyester binder fibers 5 may also be flocked directly on this surface of the film without use of a releasing paper.

The adhesive strength between the thermoplastic film and the flocked fibers 4 can be controlled by the pressure and temperature of the heat rollers, and the fibers-flocked film passing velocity. When the adhesive strength is increased beyond necessity, the deformation degree of the fibers becomes large, and its contact surface with the film becomes large, resulting in reducing the perforating property thereof. In the present invention, it is preferable to control the conditions of thermal compression properly depending upon the kinds of the fibers so that the film and fibers may be fixed by melting in line or point contact with each other.

Figure 2:
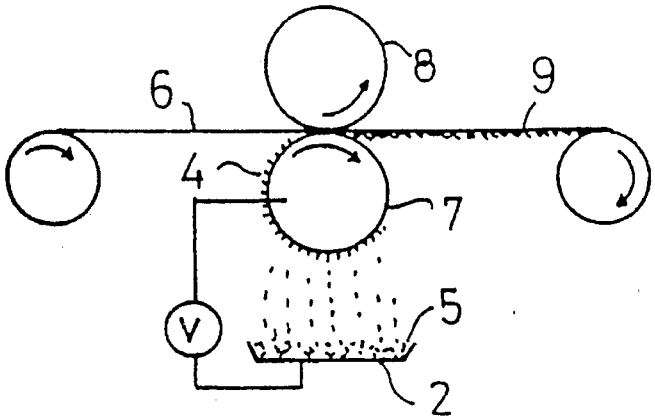
FIG. 2 is an explanatory view showing an example of an apparatus for producing a heat-sensitive stencil sheet according to the present invention.

FIG. 2 is an explanatory view showing an example of an apparatus for producing a heat-sensitive stencil sheet according to the present invention.

This apparatus is mainly composed of an electrode plate 2 to be supplied with polyester binder fibers 5, a released roller 7 having an electrode plate action, a heat roller 8 in touch with and rotating with the released roller 7, and a driving means (not shown) for the released roller 7.

In such a constitution, the released roller 7 is rotated to pass a thermoplastic resin film 6 through between the released roller 7 and the heat roller 8. Then, a certain electric voltage is applied between the released roller 7 and the electrode plate 2 to flock successively the polyester binder fiber 5 on the surface of the released roller 7. The flocked fibers 4 are superimposed on the thermoplastic resin film 6 in accordance with the rotation of the released roller and the superimposed fibers-flocked film is thermally compressed through the heat roller 8 and the released roller 7 to form a heat-sensitive stencil sheet 9.

Figure 3:
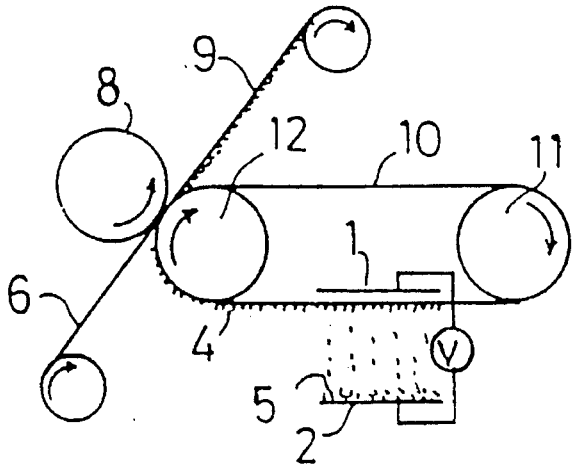
FIG. 3 is an explanatory view showing another apparatus for producing a heat-sensitive stencil sheet according to the present invention.

FIG. 3 is an explanatory view showing another apparatus for producing a heat-sensitive stencil sheet according to the present invention.

This apparatus is different from that of FIG. 2 in that two rotating rollers 11 and 12 are provided instead of the released roller 7 so as to rotate a released belt 10 and a pair of electrode plates 1 and 2 are arranged so as to flock the polyester binder fibers 5 on the released belt 10 electrostatically.

In this manner, a porous substrate layer having a good fiber dispersibility can be formed on the thermoplastic resin film 6 using a small amount of fibers by electrostatically flocking the polyester binder fibers 5 on the released belt 10, superimposing the fibers-flocked surface on the thermoplastic resin film 6 and by thermally compressing the superimposed resin film. Furthermore, the simplification in the apparatus for producing a heat-sensitive stencil sheet can be attained by electrostatically flocking the polyester binder fibers 5 directly on the thermoplastic resin film 6 and then by thermally compressing the fibers-flocked resin film.

DETAILED DESCRIPTION OF THE PREFERRED EMBODIMENTS

The detailed description of the present invention will be given with reference to examples in the following. It should be understood, however, that these examples do not limit the scope of the present invention. Incidentally, the nip pressures indicated in the following examples show the values obtained by measuring the pressures in their static conditions between the heat roller and the opposing roller by using a device for measuring a lower pressure named "PRESCALE" (Fuji Photo Film Co., Ltd. product, Trademark).

EXAMPLE 1

Shell-core type polyester conjugate fibers having each fiber length of 1 mm and fineness of 4 d (denier) treated for electrostatic flocking process, were mounted on an electrode plate, and a released paper was mounted on the other electrode plate. Then, a direct current voltage of 6000 V was applied between the electrode plates in the space of 5 cm for electrostatic flocking. A released paper, which was flocked in a flocked quantity of 15 g/m$^2$, and a polyester film having a film thickness of 2 μm, were superimposed and passed through the heat rollers at a surface temperature of 130° C. under a nip pressure of 28 kgf/cm$^2$ with a thermal compression velocity of 10 m/min to form a heat-sensitive stencil paper. The adhesive condition between the film of this sheet thus obtained and the fibers was good.

Then, after stearyl-trimethylammonium chloride as a mold lubricant was coated on the film surface, which has no flocked fibers, the heat-sensitive stencil sheet was processed and printed by an integrated type heat-sensitive stencil process printer RISOGRAPH RC335 (produce and trademark of Riso Kagaku Corporation). The resulting processing and printing properties were both good.

EXAMPLE 2

In the same manner as described in Example 1, with the exception of using shell-core type polyester conjugate fibers having a fiber length of 1 mm and fineness of 2 d, flocking in a flocked quantity of 8 g/m$^2$, and further coating a silicone oil as a mold lubricant thereon, a heat-sensitive stencil sheet was produced. The resulting sheet was further processed and printed. The adhesive condition between the film and the fibers was good, and also processing and printing properties were both good.

EXAMPLE 3

In the same manner as described in Example 2, with the exception of using polyester type shell-core type polyester conjugate fibers having a fiber length of 1 mm and fineness of 1 d, a heat-sensitive stencil sheet was produced and then, the resulting sheet was further processed and printed. The adhesive condition between the film of the sheet thus obtained and the fibers, and processing and printing properties of the resulting sheet were both good.

EXAMPLE 4

In the same manner as described in Example 2, with the exception of using normal polyester binder fibers, a heat-sensitive stencil sheet was produced and then, the resulting sheet was further processed and printed. The adhesive condition between the film of the sheet thus obtained and the fibers, processing and printing properties of the resulting sheet were both good.

EXAMPLE 5

Shell-core type polyester conjugate fibers having a fiber length of 1 mm and fineness of 4 d for electrostatic flocking process, were mounted on an electrode plate, and a polyester film having a film thickness of 2 μm was mounted on the other electrode plate. Then, a direct current voltage of 6000 V was applied between the electrode plates in the space of 5 cm to electrostatic flocking. The resulting film, which was flocked in a flocked quantity of 15 g/m$^2$, was passed through the heat rollers at a surface temperature of 130° C. under a nip pressure of 28 kgf/cm$^2$ with a thermal compression velocity of 10 m/min to form a heat-sensitive stencil sheet. The adhesive condition between the film of this sheet thus obtained and the fibers was good.

Then, after a silicone oil was coated as a mold lubricant on the film surface which has no flocked fibers, the heat-sensitive stencil sheet was processed and printed by an integrated type heat-sensitive stencil process printer RISOGRAPH RC335 (product and trademark of Riso Kagaku Corporation). The resulting processing and printing properties were both good.

EXAMPLE 6

In the same manner as described in Example 5, with the exception of using shell-core type polyester conjugate fibers having each fiber length of 1 mm and fineness of 2 d, flocking in a flocked quantity of 8 g/m$^2$, a heat-sensitive stencil sheet was produced and then, the resulting sheet was further processed and printed. The adhesive condition between the film of the sheet thus obtained and the fibers, and processing and printing properties of the resulting sheet were both good.

Comparative Example 1

All melted type polyester binder fibers having each fiber length of 1 mm and fineness of 1 d for electrostatic flocking process and normal polyester fibers were mixed with each other at a weight ratio of 1:1 and a released paper was mounted on the other electrode plate. Then, a direct current voltage of 6000 V was applied between both electrodes in the space of 5 cm for electrostatic flocking. A released paper, which was flocked in a flocked quantity of 8 g/cm$^2$, and a polyester film of 2 μm in thickness, were superimposed and passed through the heat rollers at a surface temperature of 130° C., under a nip pressure of 28 kgf/cm$^2$ and with a thermal compression velocity of 5 m/min to form a heat-sensitive stencil sheet. When the sheet thus obtained was shaken, the dropping of the fibers from the film surface was observed.

Then, a silicone oil was coated as a mold lubricant on the surface having no fibers, and the coated surface was processed and printed by an integrated type heat-sensitive stencil process printer RISOGRAPH RC335 (product and trademark of Riso Kagaku Kogyo Corporation). When processing was kept going on several sheets, the dropped fibers stayed around the thermal head and the processing property was getting bad to produce unprocessed portion on the sheet. The resulting printed matter showed white dots, white stripes and others.

Comparative Example 2

In the same manner as described in Comparative example 1, with the exception of mixing all melted type polyester binder fibers having each fiber length of 1 mm and fineness of 1 d with the normal polyester fibers at a weight ratio of 2:1, a heat-sensitive stencil sheet was produced, and then a processing and printing were carried out. The dropping of the fibers from the film thus obtained was observed. When processing was continuously done, some unprocessed portions on the resulting stencil sheet were generated and the resulting printed matter showed white dots, white stripes and others.

Comparative Example 3

Polypropylene fibers having a fiber length of 1 mm and fineness of 1 d treated for electrostatic flocking process was mounted on an electrode plate and a released paper was also mounted on the other electrode plate. A direct current voltage of 6000 V was applied in the space of 5 cm for electrostatic flocking. The released paper, which was flocked in a flocked quantity of 8 g/m$^2$, was superimposed on a polyester film of 2 μm in thickness, and passed through the heat rollers at a surface temperature of 130° C. under a nip pressure of 28 kgf/cm$^2$ and with a thermal compression velocity of 1 m/min. However, both of them could not be adhered together.

EFFECTS OF THE INVENTION

According to the heat-sensitive stencil sheet and its production process relevant to the present invention, the following effects may be obtained.

(1) Since no adhesive layer is available between the film and the porous substrate layer, the resulting perforating property is improved.

(2) Since polyester binder fibers are dispersed by electrostatically flocking process and thermally compressed to form a porous substrate layer, the resulting fiber dispersibility is improved and the perforating property and the ink permeability are both improved. Furthermore, the substrate layer can be formed in a small quantity of fibers, resulting in reducing production cost.

(3) Since no adhesive process between the film and the porous substrate is required, the quality control in heat-sensitive stencil sheets becomes easy.

(4) There is no need of producing porous substrates in another production line, and accordingly, it becomes possible to produce on the same production line from beginning to end.

What we claimed is:

1. A process for producing a heat-sensitive stencil sheet comprising the steps of:

flocking conjugate polyester binder fibers on the surface of a releasable member electrostatically;

superimposing a thermoplastic resin film on said fibers-flocked releasable member;

thermally compressing the superimposed film and fibers-flocked releasable member to obtain a heat-sensitive stencil sheet; and removing said releasable member to obtain a heat-sensitive stencil sheet.

* * * * *